United States Patent [19]

Sloate

[11] Patent Number: 4,674,539

[45] Date of Patent: Jun. 23, 1987

[54] ROTARY SERVO VALVE

[76] Inventor: Harry M. Sloate, 526 Lakeshore Dr., Barrington, Ill. 60010

[21] Appl. No.: 831,976

[22] Filed: Feb. 20, 1986

[51] Int. Cl.[4] ..... F15B 13/043

[52] U.S. Cl. ..... 137/625.64; 91/387; 91/433; 137/625.6

[58] Field of Search ..... 137/625.6, 625.64; 91/387, 433

[56] References Cited

U.S. PATENT DOCUMENTS

| | | | |
|---|---|---|---|
| 123,174 | 1/1872 | Hopkins . | |
| 2,600,348 | 6/1952 | Walthers . | |
| 2,615,466 | 10/1952 | Garde . | |
| 2,621,676 | 12/1952 | Loft . | |
| 3,023,782 | 3/1962 | Chaves, Jr. et al. . | |
| 3,106,224 | 10/1963 | Moss et al. | 137/625.63 |
| 3,125,002 | 3/1964 | McCombs, Jr. . | |
| 3,174,406 | 3/1965 | Hague et al. . | |
| 3,219,060 | 11/1965 | Pearl et al. . | |
| 3,386,457 | 6/1968 | Adams . | |
| 3,405,600 | 10/1968 | Ballard et al. . | |
| 3,420,141 | 1/1969 | Hague . | |
| 3,566,919 | 3/1971 | Vanderlaan . | |
| 3,568,718 | 3/1971 | Wilke et al. . | |
| 3,665,807 | 5/1972 | Bartholomaus et al. | 91/378 X |
| 3,674,041 | 7/1972 | Beals . | |
| 3,696,835 | 10/1972 | Pauliukonis . | |
| 4,145,956 | 3/1979 | Rumrill et al. | 137/625.64 X |
| 4,243,062 | 1/1981 | Shelton . | |
| 4,281,676 | 8/1981 | Morris . | |
| 4,368,750 | 1/1983 | Burton . | |
| 4,371,178 | 2/1983 | Ott . | |
| 4,545,409 | 10/1985 | Luhmer | 137/625.64 |

OTHER PUBLICATIONS

Atchley Controls, Inc., JET-PIPE Servovalves, *A Design for Reliability brochure.*

Olsen Controls, Inc., Model LS-300, Linear Device specifications.

Moog Inc., Servovalve brochure.

Copy of a photograph of an Air Directional Spool Valve with Solenoid Controlled Pilot Stage.

*Primary Examiner*—Gerald A. Michalsky

*Attorney, Agent, or Firm*—Willian Brinks Olds Hofer Gilson & Lione Ltd.

[57] ABSTRACT

An axial bore which extends through the spool and receives a control rod. Channels formed in the control rod cooperate with radial passageways in the valve spool. A pair of torsion rods extend axially from the control rod. One is coupled to a stepping or torque motor, the other is coupled to a rotatable drive member. An assembly for converting axial motion to rotary motion couples the valve spool to the drive member. In the preferred embodiment, this assembly takes the form of a rotatable threaded member secured to the end of the torsion rod and receiving a complementarily threaded end portion of the valve spool. One alternate embodiment comprises a pair of threaded rods extending from the spool, which drives a centrally disposed gear through a pair of complementarily threaded pinion gears. In another alternate embodiment a pressure control valve is achieved. Output fluid from the spool valve is applied to opposite sides of a threaded piston, which is spring biased by opposed compression springs. The piston is received upon a complementarily threaded shaft and axial motion of the piston is converted to rotary motion of the shaft. The shaft is coupled to an end of one of the torsion bars through a pair of gears.

23 Claims, 12 Drawing Figures

ROTARY SERVO VALVE

BACKGROUND OF THE INVENTION

This invention relates to pilot controlled spool valves and, in its presently preferred embodiments, to new and improved rotary servo controlled pilot stages and spool valves.

Spool-type valves are typically used to control the flow of fluid, such as hydraulic oil, water or air to a hydraulic cylinder or similar device. The size and diameter of the spool determine the flow capacity of the valve and thus the rate of energy transfer through the valve. The position of the spool within its valve body controls the amount and direction of fluid flow through the valve. Because the fluid flow forces and spool mass are typically high, pilot stages can be used to control the spool position which in turn controls the fluid flow.

There are generally three types of spool-type valves: directional control, proportional control, and servo or feedback control. Directional control valves are used to commence and interrupt fluid flow. These valves are used in the majority of fluid control applications. Proportional control pilot valves control the amount of fluid flow in proportion to an input signal. The use of these valves in applications is increasing. Servo-type pilot valves use mechanical feedback from the spool to a pilot stage to control spool position. These valves are used in high performance, proportional control applications where accurate closed loop control is essential.

One conventional type of directional spool valve uses a solenoid to control spool position. A first solenoid is attached to one end of the valve housing and the solenoid plunger is coupled to one end of the valve spool. A second solenoid is attached to the opposite end of the valve housing and the plunger of the second solenoid is coupled to the opposite end of the valve spool. The solenoids are alternately energized to move the spool and start and stop the fluid flow. Specifically, when the first solenoid is energized, it forces its iron plunger in a direction which moves the spool to turn on fluid flow in one direction. When the second solenoid is energized, its iron plunger moves the spool to turn on fluid flow in the other direction.

This type of conventional directional valve has several drawbacks. The two solenoids and their associated electrical connections add bulk, weight, and significant power consumption to the valve package. The iron slugs are relatively heavy and thus require significant electrical energy to be moved by the solenoids. Twenty-four volts and one amp give typical electrical requirements of twenty-four watts of power. Of greater concern in systems is the slow response of such solenoids which is generally around 100 milliseconds.

One type of conventional proportional valve also uses a solenoid to control spool position. In this valve, however, a solenoid and its plunger are attached to only one end of the spool. A spring is attached to the other end of the spool. When the solenoid is energized it moves its plunger in a direction to push the spool against the bias of the spring. The force of the spring provides proportional control of the flow of fluid. When the solenoid is de-energized, the spring returns the spool to the off position.

This type of proportional valve also shares the drawbacks of the solenoid controlled directional control valve. Specifically, high electrical current, and thus power, is necessary to move the spool against the spring. Moreover, this design is not well suited for high pressure applications.

A widely used servo-type valve is disclosed in U.S. Pat. No. 3,023,782 (Chaves). This valve uses a torque motor pilot stage with negative feedback provided by a flapper 73 in mechanical contact with the spool. The pilot stage shifts the spool, which can be subject to large fluid forces, in response to a small electrical signal to the torque motor. The position of the flapper is negatively fed back to the pilot stage to control the spool position. This negative feedback provides linearity and minimizes hysteresis.

While the Chaves servo valve provides some advantages, it also has significant disadvantages. These valves are complex and expensive to manufacture. The current price for a 10 gallon per minute valve is around $1000.00. Furthermore, these valves are susceptible to clogging due to the small mechanical orifices (on the order of 0.005 inch) in the pilot stage. Thus, extensive filtering of hydraulic fluid is necessary to avoid contamination problems.

Another servo operated spool valve is disclosed in U.S. Pat. No. 3,106,224 (Moss). This patent discloses a spool 1 and a cylindrical spindle 13, which extends through an axial bore in the spool and the two ends of the valve housing 7. Two helical grooves 15 and 16 are formed in the surface of the spindle and are spaced from each other by approximately one-half helical pitch, so that each groove extends from one end of the valve housing cavity past a pair of diametrically opposed radial bores 17 in the spool. In its central position, the radial bores should be inside the central port 3 of the valve housing, and each groove should uncover equal parts of one of the radial bores.

The spool is maintained in its central position by a continuous flow of oil through the valve housing and spool that provides equal fluid pressure at both ends of the housing bore. In particular, the oil flows along two branches from the pressure inlet 24, through ports 2 and 4, passages 20 and 22, and orifices 21 and 23, to the two end chambers of the bore in housing 7, through the grooves 15 and 16 and the radial bores 17 to the drain port 12. In this central, null position, lands 5 and 6 block the flow of oil through the service ports 10 and 11.

In order to move the spool axially, the spindle 13 is rotated. This will cause one groove to uncover a greater portion of one radial bore and the other groove to cover a greater portion of the opposite radial bore. As a result, the fluid pressure in one end chamber of the valve housing will be greater than the other, and the spool will move towards the chamber of lower pressure until the fluid pressure in each chamber is equal. At this point, each radial bore will be uncovered the same amount again. The axial movement of the spool is proportional to the rotary displacement of the spindle 13.

The Moss servo valve is less complex and more desirable than the Chaves servo valve. However, the Moss servo valve also has some significant drawbacks. The Moss valve is designed to have continuous oil flow, even at null, between both ends of the valve housing to balance the pressure across the spool. The continuous flow requirement consumes power even at null. The design complicates the manufacture of the valve. The spindle grooves 15 and 16 and radial bores 17 must be designed in a relationship that facilitates constant flow. The passages 20 and 22 and orifices 21 and 23 must be machined into the outer lands 18 and 21 of the spool.

The orifices 21 and 23 must be the same size so that each end chamber has about one-half of the fluid pressure at the null position. The orifices and radial holes should also be small to minimize flow at null. The small holes, however, are more prone to contamination.

SUMMARY OF THE INVENTION

The present invention is directed to an improved pilot control for valves utilizing a rotary servo mechanism. In many aspects, the invention and following disclosure are similar to or incorporate portions of my pending patent application Ser. No. 705,076 filed Feb. 25, 1985, directed to Pilot Controlled Valves, which is hereby incorporated by reference.

In a preferred embodiment, a rotary servo valve of spool having a plurality of spaced apart lands separated by reduced diameter regions, which cooperate with axially spaced-apart inlet, return and service ports. The servo mechanism includes an axial slidable piston connected to the valve spool. An axial bore extends through the spool and receives a control rod. A pair of diametrically opposed axially extending channels are formed in the control rod, and cooperate with first and second pairs of radially aligned, spaced apart passageways in the valve spool. A pair of torsion rods extend axially from the ends of the control rod. One is coupled to a control motor, such as a torque actuator or stepping motor. The other is coupled to a rotating drive member. The rotating drive member includes internal threads which receive a complementarily threaded end portion of the valve spool. Axial motion of the valve spool is converted to rotational motion of the drive member.

In operation, readjustment from a null point is initiated by rotation of the control rod by the stepping motor through the first torsion rod. Such rotation aligns one of the pairs of radial passageways in the valve spool with the adjacent axial channel thereby increasing or reducing pressure on the piston and axially repositioning the valve spool. Such axial repositioning of the valve spool causes rotation of the drive member, which twists the second torsion rod. This action applies a countertorque to the control rod in a direction opposite to the torque and rotation initially applied by the stepping motor. Such lateral displacement of the spool and rotation of the end of the second torsion rod continues until the control rod rotates to its original position and the radial bores are blocked, terminating flow to the spool valve piston. Thus, the valve spool is displaced axially by an amount proportional to the rotation originally applied by the torque motor.

In a first alternate embodiment, construction of the rotary servo valve is substantially the same except that the threaded end portion of the valve spool and rotating member are replaced by a pair of parallel threaded rods extending from the valve spool which drive a centrally disposed spur gear through a pair of complementarily threaded pinion gears. But for the structural differences, the operation and servo action of the first alternate embodiment is the same as that of the preferred embodiment.

A second alternate embodiment employes the teachings of the invention in a three way servo valve. A mechanical input by the control motor causes the control rod and thence the valve spool to translate one way to proportionally connect the fluid pressure input to a service port, or the opposite way to connect the fluid return port to the service port.

In a third alternate embodiment a pressure control valve is achieved. Output fluid from the service ports of the spool valve is applied to opposite sides of a threaded piston, which is spring biased by opposed compression springs preferably having equal spring rates. The piston is received upon a complementarily threaded shaft, so that axial motion of the piston is converted to rotational motion of the shaft. The shaft, in turn, is coupled to the second torsion bar; the first torsion bar being coupled to the control motor. This device operates somewhat differently in that pressure differential between the service ports of the servo valve causes the piston to displace a distance determined by the spring rate of the opposed springs. As the piston moves, the threaded shaft rotates, and this angular displacement is transferred to the end of the second torsion rod through two gears. This displacement applies a torque to the control rod in a direction opposite to the torque originally applied by the control motor. Sufficient displacement of the piston returns the control rod to a null position and flow to the chambers surrounding the piston at the end of the spool valve is terminated.

The present invention provides important advantages over conventional pilot controlled valves. The present invention is simple to manufacture and to adapt to existing valves. The spool of an existing valve needs only to have the axial bore and radial bores, the control rod having the requisite torsion rod portions and axial channel, as well as the addition of an axial to rotary motion conversion assembly to practice the present invention. The control rod can be readily machined into different configurations to provide directional control or various degrees of proportional control. In either case, the present invention provides inherent servo control or feedback such that fluid flow is terminated when the spool has been repositioned and a null point reached.

Another advantage of the present invention is that the size and shape of the radial bores are not as critical as in the Moss design. In fact, it is best that the radial bores in the present invention be large to prevent contamination and axially spaced apart to minimize leakage.

Still another advantage of the present invention is that the control rod can be actuated by a low power actuator since the control rod has low mass and is subject to low frictional forces. Moreover, the control rod ultimately controls substantial fluid volumes, thus providing significant fluid amplification without the cost of high input power. It should be noted that the low power actuator is well suited for direct computer control.

A still further advantage of the present invention is the simplicity of the servo mechanism itself. Finally, it is worthwhile to note that the gain or amplification of the servo mechanism can be readily changed by changing the pitch and lead of the threads which couple the axially translating and rotationally moving members.

The invention itself, together with further objects and attendant advantages, will best be understood by reference to the following detailed description taken in conjunction with the drawings.

DESCRIPTION OF THE PREFERRED EMBODIMENTS

Figure 1:
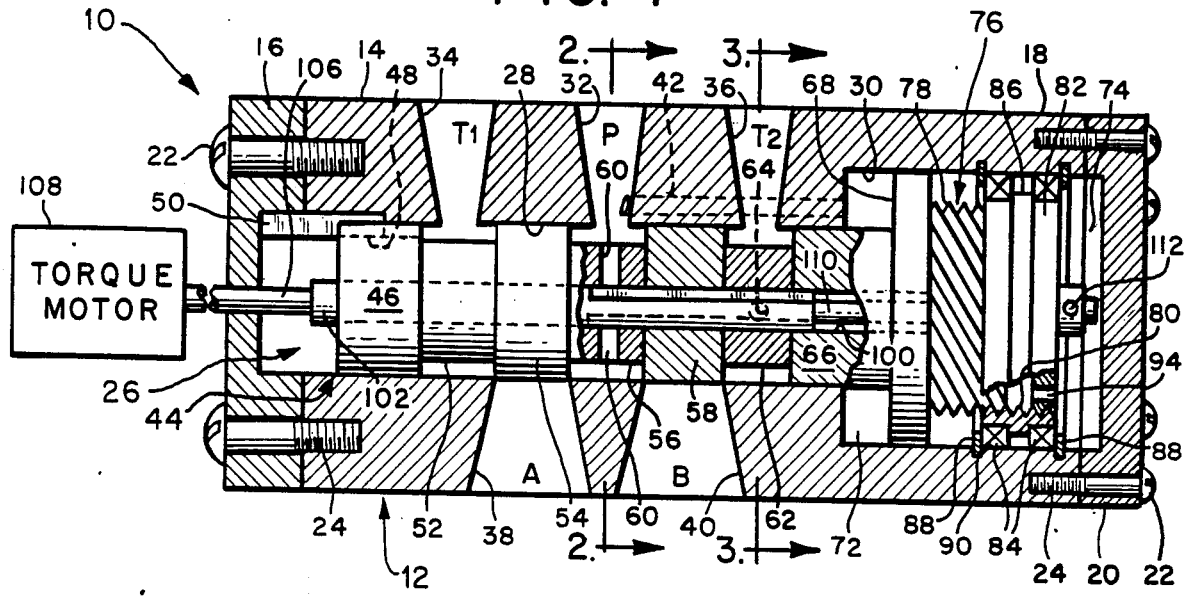
FIG. 1 is a longitudinal, full sectional view with portions broken away of a preferred embodiment of the present invention.
Figure 2:
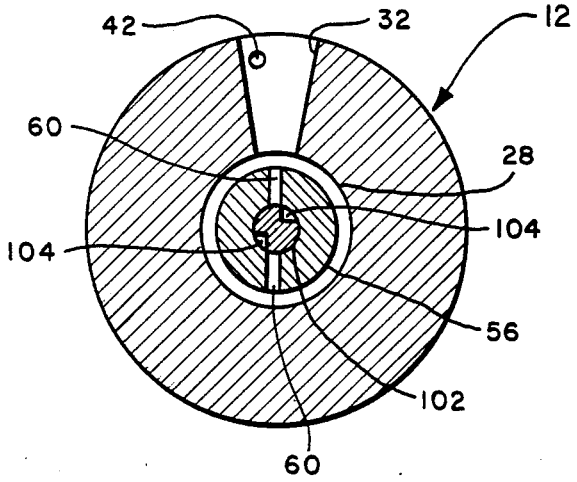
FIG. 2 is a full sectional view of the preferred embodiment taken along line 2—2 of FIG. 1.

The present invention will now be described with reference to the various embodiments illustrated in the drawings. These drawings depict a preferred embodiment and three alternate preferred embodiments. It should be understood that the present invention is not to be limited to the embodiments illustrated in the drawings and described below. Rather, the invention is intended to apply to control valves generally, especially spool-type valves, and the embodiments shown and described herein are illustrative and representative, only. It will be apparent to those skilled in the art that the present invention can be adapted to many variations in addition to those described herein.

Turning first to the preferred embodiment illustrated in FIGS. 1, 2, 3, and 4, a rotary servo valve according to the present invention is illustrated and generally designated by the reference numeral 10. The rotary servo valve 10 includes a generally cylindrical housing 12 having a first open end 14 which is closed by a first end plate 16 and a second open end 18 which is closed by a second end plate 20. The first and second end plates 16 and 20, respectively, are secured to the housing 12 by pluralities of fasteners such as machine screws 22 which are received within suitably threaded blind openings 24. An axial bore 26 extends longitudinally through the valve housing 12 from the first open end 14 to the second open end 18. The axial bore 26 defines a first, smaller diameter portion 28 extending along a greater axial portion of its length and a second, larger diameter portion 30 extending along a lesser axial portion of its length.

Figure 3:
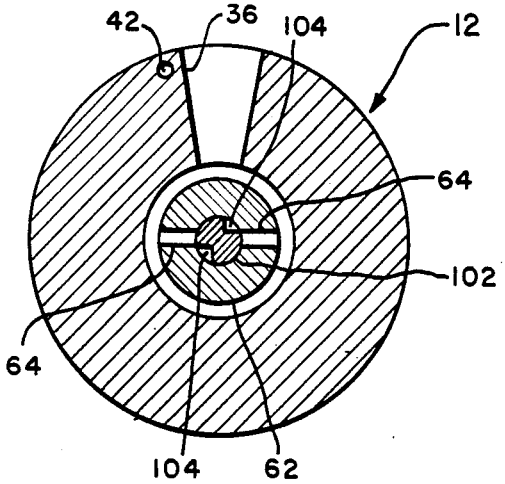
FIG. 3 is a full sectional view of the preferred embodiment taken along line 3—3 of FIG. 1.

A plurality of radially extending passageways or ports communicate with the smaller diameter portion 28 of the axial bore 26. Specifically, there is a centrally disposed pressure inlet port 32 (P), a first pressure return port 34 (T1), a second pressure return port 36 (T2), a first service port 38 (A), and a second service port 40 (B). The relative circumferential positions of the ports 32, 34, 36, 38, and 40 is without significance. Thus, in FIG. 1, the ports have been arranged in a planar alignment primarily for purposes of illustration and clarity. The housing 12 also includes an inlet passageway 42 communicating between the pressure inlet port 32 and the end of the larger diameter portion 30 of the axial bore 26 adjacent the smaller diameter portion 28. As best illustrated in FIG. 3, the passageway 42 is adjacent but circumferentially offset from the second pressure return port 36.

Axially slidably disposed within the axial bore 26 is a valve spool 44. The valve spool 44 defines a plurality of alternating lands and reduced diameter portions within the first, smaller diameter portion 28 of the axial bore 26, and a larger diameter piston or control land within the second, larger diameter portion 30 of the axial bore 26. There is a first land 46 which generally defines the end of the valve spool 44 most proximate the first end plate 16. The first land 46 defines an axially extending channel or keyway 48 which slidably receives a complementarily sized and axially oriented key 50 formed in or secured to the wall of the axial bore 26 of the housing 12. Cooperation between the keyway 48 and the key 50 inhibits rotation of the valve spool 46 while permitting motion along its axis. Axially spaced from the firt land 46 by a reduced diameter region 52 is a second land 54. The second land 54 has a width measured along the axis of the valve spool 46 equal to the width of the first service port 38 at its juncture with the axial bore 26. A second reduced diameter region 56 separates the second land 54 from a third land 58. The third land 58 has an axial width equal to the width of the second service port 40 at its juncture with the axial bore 26 and is spaced from the second land 54 such that they both seal off the respective service ports at a given position of the valve spool 44, such position being illustrated in FIG. 1. Positioned axially intermediately between the lands 54 and 58 are a first pair of aligned, radially oriented bores 60 which extend inwardly from the surface of the second reduced diameter region 56. Adjacent the third land 58 is a third reduced diameter region 62. A second pair of aligned, radially oriented bores 64 extend inwardly from the surface of the third reduced diameter region 62. The bores 64 are disposed at right angles to the bores 60 in the second reduced diameter region 56. Finally, a fourth land 66 extends from the third reduced diameter region 62 to a piston 68.

The land 46, 54, 58, and 66 and the piston 68 are machined to provide approximately 1/1000 of an inch clearance between them and the surface of the axial bore 26. If desired, the piston 68 may be provided with a O-ring type seal. It should also be noted that the lands just recited can be provided with circumferential centering grooves to counteract any pressure imbalances as is well known in the art.

The piston 68 divides the second, larger diameter portion 30 of the axial bore 26 and defines a first chamber 72 and a second chamber 74. The effective area of the piston 68, that is, that surface area exposed to fluid pressure in the first chamber 72 is preferably one-half the effective area of the piston 68 in the second chamber 74. The inlet passageway 42 opens into the first chamber 72, and thus provides communication between the pressure inlet port 32 and the first chamber 72.

The portion of the valve spool 44 on the side of the piston 68 opposite the lands and reduced diameter regions, that is, that portion within the chamber 74, includes a hollow cylindrical stub 76 having male threads 78. The male threads 78 are of right-hand sense and are formed or cut such that significant lead, that is, axial translation along the thread line, will occur with relatively small angular motion. The lead of the male threads 78 affects the amplification of the rotary servo valve 10, as will be more fully described subsequently. The male threads 78 engage complementary right-hand female threads 80 on the inner surface of a hollow rotating cylinder 82.

Figure 11:
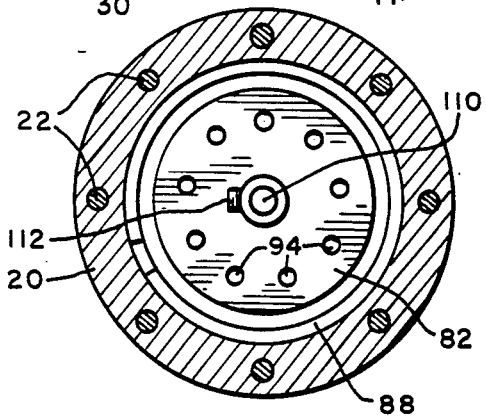
FIG. 11 is a full sectional view of the second alternate embodiment taken along line 11—11 of FIG. 9.

The rotating cylinder 82 is supported within the housing 12 by a pair of spaced apart anti-friction bearings, such as the ball bearing assemblies 84. Inasmuch as the primary operating forces on the bearing assemblies 84 are axially oriented, they should be of a suitable design to withstand and transfer axially directed forces in addition to providing low friction between the rotating cylinder 82 and the housing 12. The outer surface of the rotating cylinder 82 defines a centrally disposed circumferential ridge 86 which each bearing assembly 84 contacts about one of its respective edges. Immediately adjacent the opposite, outer edge of each of the two bearing assemblies 84 is a circular retaining washer or ring 88, which is received within a respective pair of channels or grooves 90 formed in the wall of the second, larger diameter portion 30 of the axial bore 26. The bearing assemblies 84 thus support he rotating cylinder 82 for free rotation about its axis while inhibiting motion in either direction along its axis. The inter-engaging male and female threads 78 and 80, respectively, provide a coupling which converts the axial motion of the valve spool 44 into rotating motion of the rotating cylinder 82. The rotating cylinder 82 defines a plurality of axial passageways 94, which communicate between the interior and exterior of the rotating cylinder 82. One of the passageways 94 is illustrated in FIG. 1, and all are illustrated in FIG. 11.

The valve spool 44 defines a co-axial through passageway or bore 100 which extends from one end of the valve spool 44 to the other. The bore 100 intersects the pairs of radial bores 60 and 64. Slidably and rotatably received within the bore 100 is a control rod 102. The control rod 102 defines a pair of diametrically opposed right angle channels 104. The channels 104 extend from the end of the control rod 102 generally adjacent the fourth land 66 axially a short distance past the first pair of radial bores 60. The opposed arrangement of the channels 104 provides pressure balancing of the control rod 102, thereby minimizing the magnitude of forces required to move it.

The ends of the control rod 102 are coupled to, or integrally formed with, a pair of torsion bars 106, 110. A first torsion bar 106 couples the end of the control rod 102 adjacent the first land 46 to an input control motor, such as a stepping or torque motor 108. A second torsion bar 110 couples the opposite end of the control rod 102 to the rotating cylinder 82. The rotating cylinder 82 may be secured to the second torsion bar 110 by any suitable fastening means, such as a set screw 112. The torsion rods 106 and 110 are preferably identical; being composed of the same material and having the same diameter and effective length such that they provide the same torsional spring constant. However, the actual shape, length, or composition of the torsion rods 106 and 110 is not critical. That is, they may be of any configuration, such as frustoconical, of various cross sections, such as rectangular or square, of larger diameters (the practical limit being the diameter of the bore 100) and of materials different than the control rod 102. As will be more fully understood upon study of the following operational sections, the torsion rods 106 and 110 accept and provide rotational torques and counter torques, which effectively rotationally "center" the control rod 102. Equivalent mechanical means are therefore contemplated and incorporated herein.

The operation of the preferred embodiment rotary servo valve 10 will now be described with reference to FIGS. 1 through 4. In FIG. 1, the rotary servo valve 10, particularly the valve spool 44 and the control rod 102, is illustrated in an equilibrium or null position, where forces across the spool are in balance. In this position, the second land 54 blocks the first service port 38, and the third land 58 blocks the second service port 40. Thus, there is not fluid flow between either the pressure inlet port 32 and the service ports 38 and 40, or the pressure return ports 34 and 36 and the service ports 38 and 40. In this state the control rod 102 is also in a null position, blocking both the first and second pairs of radial bores 60 and 64, so that there is no pilot flow through channels 104. The first pair of radial bores 60, however, are in fluid communication with the pressure inlet port 32, and the second pair of radial bores 64 are in fluid communication with the second pressure return port 36. It should also be noted that the first chamber 72 is in fluid communication with the pressure inlet port 32 through the passageway 42, and thus the first chamber is filled with a fluid such as oil, water, or air. Likewise, the second chamber 74 is filled with the same fluid by virtue of previous operation and flow which may enter the chamber 74 from the radial bores 60, along the channels 104 and the annular space about the second torsion bar 110, through the space between the male and female threads 78 and 80, respectively, and through the axial passageways 94. Finally, for purposes of explanation, the control rod 102 is assumed to be rigid. Thus, opposed torques applied to the outer ends of the torsion rods 106 and 110 will only rotationally flex or twist them, not the control rod 102.

A change from the equilibrium or null position is commenced by the torque motor 108 upon command from a computer or other type of proportional controller. The nature and operation of the torsion bars 106 and 110 will best be understood by the utilization of a numerical example. For the purpose of illustration, it will be assumed that the torque motor 108 provides a counterclockwise (as viewed in FIGS. 2 and 3) step input of 30° to the end of the first torsion bar 106. Because, at least initially, the rotating cylinder 82 and the end of the second torsion rod 110 secured thereto does not rotate, the torsion rods 106 and 110 twist equally, and the control rod 102 rotates one half of this motion, or 15°, counterclockwise. In other words, the second torsion rod 110 applies a counter torque to the control rod 102, resisting rotational motion, and the control rod 102 rotates only one-half the torque motor 108 input. The control rod channels 104 are thus rotated into partial alignment with the first pair of radial bores 60, and high pressure fluid begins to pass along the channels 104, through the bore 100 of the valve spool 44, and into the chamber 74. Fluid pressure against the face of the piston 68 within the chamber 74 thus increases. Such pressure increase and the resulting force translates the valve spool 44 to the left in FIG. 1, such that the pressure inlet port 32 is placed in fluid communication with the first service port 38, and the second service port 40 is placed in fluid communication with the second pressure return port 36.

Lateral displacement of the valve spool 44 causes rotation of the cylinder 82 due to its threaded interconnection with the valve spool 44 via the threaded stub 76. The cylinder 82, and the attached second torsion bar 110, rotates in a direction opposite to the rotation of input motor 108. Specifically, the lateral displacement of the valve spool 44 continues until the cylinder 82 has rotated 30° clockwise, such that the torsion rods 106 and 110 are further twisted. The control rod 102 returns clockwise 15°, to its starting null position, so that the first pair of radial bores 60 are closed. Thus, the valve spool 44 and the rotary servo valve 10 are again in a state of equilibrium.

When the previous rotational input of the torque motor 108 is reversed and it rotates the end of the first torsion rod 106 30° clockwise to its initial position, the end of the second torsion bar 110 secured to cylinder 82 is temporarily fixed at an angular position of 30° clockwise. The second torsion rod thus provides a counter torque, so that the control rod 102 only rotates clockwise 15° when the input motor is reversed. This control rod rotation aligns the channels 104 with the second pair of radial bores 64, thereby placing the chamber 74 in fluid communication with the second pressure return port 36. This action reduces the pressure within the chamber 74. Since the chamber 72 on the opposite face of the piston 68 is in fluid communication with the supply of fluid at operating pressure, the valve spool 44 then axially translates to the right as viewed in FIG. 1. This axial spool motion causes rotation of the cylinder 82, and the attached second torsion bar 110, in the counterclockwise direction. Again the rotation of the cylinder 82 and second torsion bar 110 is in the opposite direction of rotation at the input motor. Null or equilibrium is achieved when the end of the second torsion rod 110 has rotated counterclockwise 30°, to its initial, untwisted position, thus rotating the control rod 102 15° counterclockwise, to its starting null position, and closing off the second pair of radial bores 64.

Several advantages of the instant invention should be noted. First of all, the electric actuator, such as the torque motor 108, used to rotationally position the control rod 102 moves through relatively small displacements. Thus, small air gaps can be used in the magnetic circuit of the motor. Correspondingly small power consumption is therefore enjoyed. Secondly, the drawings make manifest the relatively simple structure of the this type of servo valve. And, since the required tolerances are not narrow, the product is relatively inexpensive to design and manufacture. Thirdly, because the radial bores 60 and 64 can be of relatively large diameter, they are much less contamination prone than conventional devices. Lastly, the axial translation to rotational motion relationship between the valve spool 44 and the rotating cylinder 82 is established by the pitch and lead of the threads 76 and 78. Variations in this relationship affect the sensitivity or amplification of the servo valve 10. Increasing the lead (translation per rotation) increases the sensitivity and vice versa.

Turning now to FIGS. 5, 6, 7 and 8, the first alternate embodiment 114 of the instant invention is illustrated. The first alternate embodiment of the rotary servo valve 114 is identical in many respects to the preferred embodiment valve 10. As such, it includes a housing 12 having a first end 14 and a first end plate 16, a second end 18 and a second end plate 20, an axial bore 26 having a first smaller diameter portion 28 and a second, larger diameter portion 30. The housing 12 also defines a pressure inlet port 32(P), a first pressure return port 34(T1), a second pressure return port 36(T2), a first service port 38(A), and a second service port 40(B). All of the above delineated ports intersect and communicate with the first, smaller diameter portion 28 of the axial bore 26. A passageway 42 communicates between the pressure inlet port 32 and the second, larger diameter portion 30. A valve spool 116 is slidably received within the axial bore 26. Serially, from left to right in FIG. 5, the valve spool 116 includes a first reduced diameter region 52, a second land 54, a second reduced diameter region 56, a third land 58, a third reduced diameter region 62, and a fourth land 66. A first single radial bore 118 extends inwardly from the second reduced diameter region 56 and a second single radial bore 120 extends inwardly from the third reduced diameter region 62. The first bore 118 and second radial bore 120 are parallel and axially spaced apart. The valve spool 116 also includes a piston 68 which divides the second larger diameter portion 30 of the axial bore 26 into a first chamber 72 and a second chamber 74. Extending parallel and axially from the piston 68 are a pair of threaded shafts 122 of right hand sense. The threaded shafts 122 are preferably received within a pair of blind openings 124 formed in the second end plate 20. The threads on the threaded shafts 122 are preferably of a relatively large pitch and lead such that significant axial travel is accomplished along the thread line for a relatively small angular rotation. A pair of pinion gears 126 have right hand female threads which are complementary to the threads on the threaded shafts 122. The pair of pinion gears 126 are axially restrained on one side by the second end plate 20 and on the opposite side by suitable means such as a split washer or annulus 128, which is received within a suitably configured channel 130 formed in either the end of the housing 12, the second end plate 20, or portions of both. The pair of pinion gears 126 engage a centrally disposed spur gear 132. The foregoing assembly of the threaded shafts 122, the pair of pinion gears 126, and the spur gear 132 provide a means whereby axial motion of the valve spool 116, and connected threaded shafts 122, is converted to rotational motion of the spur gear 132.

The first alternate embodiment of the servo valve 114 also includes a control rod 134 axially slidably received within the axial bore 100 of the valve spool 116. The control rod 134 defines a chordal surface 136 resulting from the removal of an axially extending chordal segment. The chordal surface 136 cooperates with the axial bore 100 to define an axially extending passageway 138. The axial passageway 138 permits selective fluid communication between the radial bores 118 and 120 and the chamber 74. The chordal surface 136 extends from the right and of the control rod 134 beyond the first radial bore 118. It will be appreciated that the configuration of the single radial bores 118 and 120 and the single passageway 138 is unbalanced, that is, experiences unopposed fluid forces whereas the corresponding components of the preferred embodiment are of a balanced configuration, as noted. The advantage of the unbalanced configuration is less complicated manufacture.

Axially extending from and connected to the control rod 134 are first and second torsion rods 106 and 110, respectively. The first torsion rod 106 is coupled to a torque motor 108, and the second torsion rod 110 is secured to the spur gear 132 by a set screw 112 or other suitable fastening means. It is preferred that the active lengths of the torsion rods 106 and 110, that is, that portion of the torsion rods between the end of the control rod 134 and their point of attachment to the torque motor 108 or the spur gear 132 be of equal length, such that they provide equal torsional spring constants as in the preferred embodiment.

It will be appreciated that the first alternate embodiment rotary servo valve 114 is similar in most respects to the preferred embodiment servo valve 10. The primary differences relate to the mechanism which converts the axial motion of the valve spool 116 to rotary motion to effect rotation of the torsion rod 110 and the control rod 134, and to the pilot flow control scheme of the control rod 134, and the single radial bores 118 and 120. Thus, at this juncture, a basic understanding of the operation of the rotary servo valve 10 will be presumed and only the differences between it and the first alternate embodiment rotary servo valve 114 will be described below.

Figure 5:
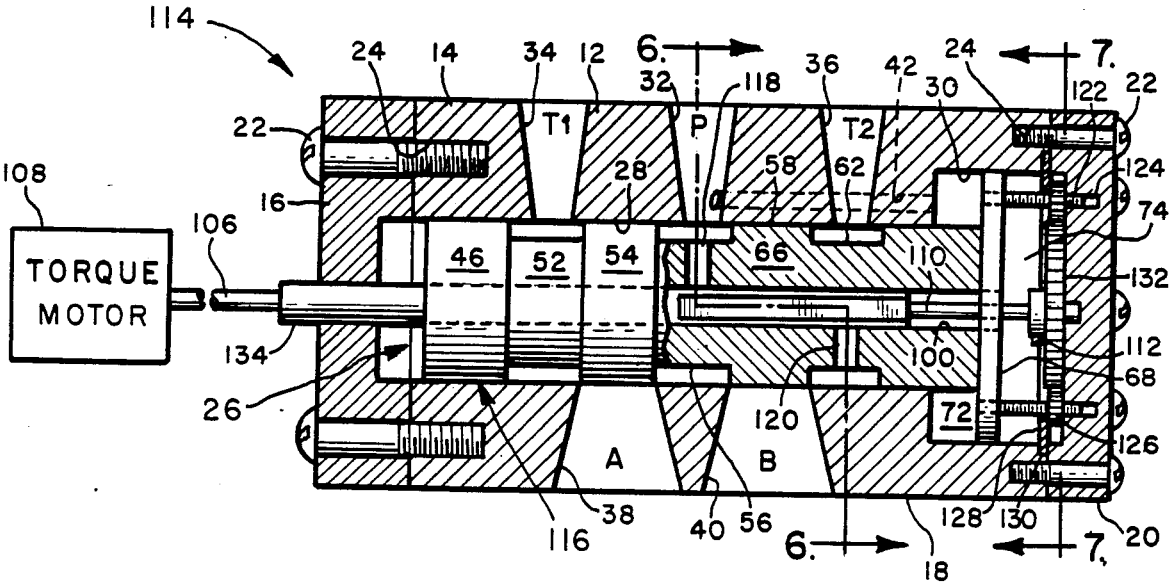
FIG. 5 is a longitudinal, full sectional view of a first alternate embodiment of the present invention.
Figure 6:
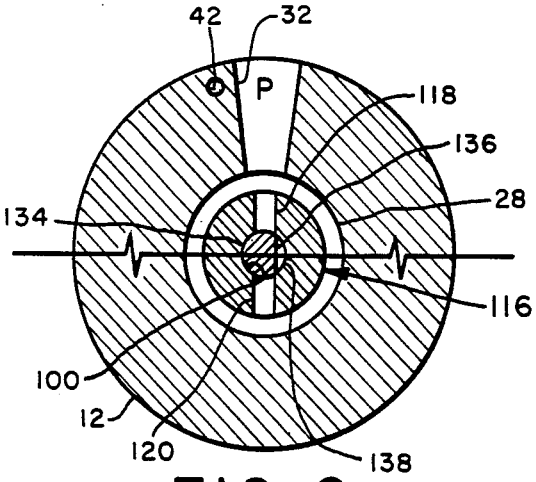
FIG. 6 is a full sectional view of the first alternate embodiment taken along line 6—6 of FIG. 5.
Figure 7:
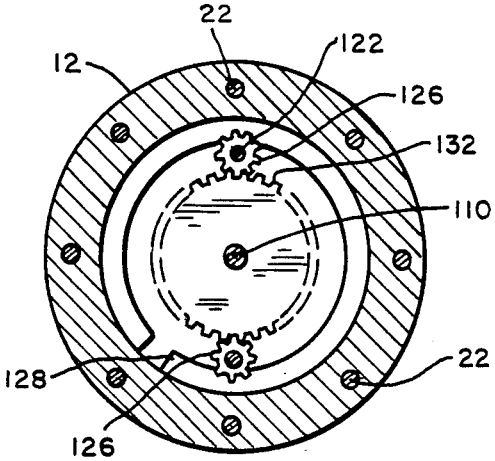
FIG. 7 is a full sectional view of the first alternate embodiment taken alone line 7—7 of FIG. 5.

The operation of the first alternate embodiment rotary servo valve 114 will be described beginning at the equilibrium position illustrated in FIG. 5. An external source such as a computer (not illustrated) activates the torque motor 108 causing rotation of the left end of the first torsion rods 106. Since the control rod 134 is presumed to be rotationally rigid along its length, only the torsion rod 106 and 110 rotationally flex. And, because the right end of the second torsion rod 110 is initially fixed, the second torsion rod 110 provides a counter torque to the action of the torque motor 108. The control rod 134 thus assumes a position equivalent to one-half of the rotational input provided by the torque motor 108, as previously described.

For purposes of example and explanation, an initial rotation of 30° counterclockwise of the torque motor 108 will be assumed. This rotation rotates the chordal surface 136 of the control rod 134 into partial alignment with the first radial bore 118 of the valve spool 116, thereby providing fluid communication along the passageway 138 between the pressure inlet port 32 and the second chamber 74. Pressure on the face of the piston 68 within the chamber 74 translates the valve spool 116 axially to the left as viewed in FIG. 5, placing the pressure inlet port 32 in communication with the first service port 38 and the second service port 40 in communication with the second pressure return port 36. Such axial motion of the valve spool 116 and attached threaded shafts 122 rotates the pair of pinion gears 126, which rotate the spur gear 132 and the attached right end of the second torsion bar 110 in the direction opposite of the input rotation. The second torsion rod continues to turn until it rotates the control rod back to its null position, terminating communication between the first radial bore 118 and the chamber 74. At this time, the valve spool 116 has once again attained equilibrium, and the valve spool 116 and the control rod 134 will remain in their respective positions until the torque motor 108 is repositioned. Rotation of the torque motor 108 in the opposite direction turns the control rod so as to connect the second radial bore 120 with the chamber 74. The high pressure hydraulic fluid in chamber 74 then vents through the second pressure return port 36 via axial passageway 136 and the second radial bore 120. The valve spool 116 then axially translates to the right until such time as its axial motion causes sufficient rotational motion of the control rod 134 (through the threaded shafts 122, pinion gears 126, spur gear 132, and second torsion rod 110) that fluid communication through the second radial bore 120 is terminated. Clearly, initial clockwise rotation of the control rod 134 and subsequent counterclockwise rotation cause correspondingly opposite axial translations of the valve spool 116.

Figure 9:
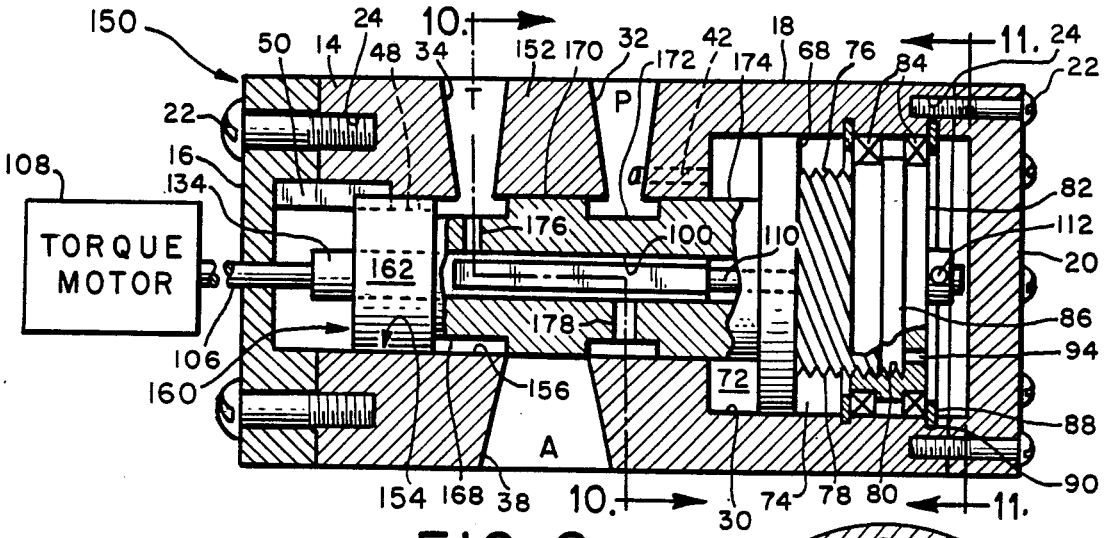
FIG. 9 is a longitudinal, full sectional view with portions broken away of a second alternate embodiment of the present invention.
Figure 10:
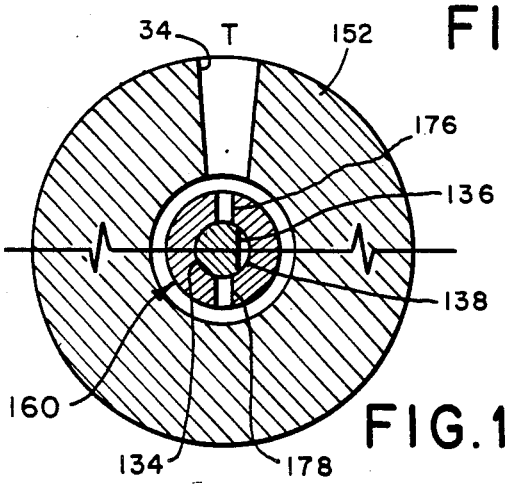
FIG. 10 is a full sectional view of the second alternate embodiment taken along line 10—10 of FIG. 9.

Turning now to FIGS. 9, 10 and 11, a second alternate embodiment 150 of the rotary servo valve is illustrated. The second alternate embodiment rotary servo valve 150 may be generally classified as a three-way valve having a pressure port, a return port, and a service port. The second alternate embodiment 150 is similar in general construction to the previously described embodiments and shares certain features of both. The second alternate embodiment rotary servo valve 150 includes a generally cylindrical housing 152 having a first open end 14, which is closed by a first end plate 16, and a second open end 18, which is closed by a second end plate 20. The first and second end plates 16 and 20, respectively, are secured to the housing 152 by pluralities of fasteners such as machine screws 22, which are received within suitably threaded blind openings 24. A through passageway or bore 154 extends longitudinally through the valve housing 152 from the first open end 14 to the second open end 18. The axial bore 154, has a first, smaller diameter portion 156 extending along a greater portion of the bore 154 and a second, larger diameter portion 30 extending along a lesser portion of the bore 154.

A plurality of radially-extending passageways or ports communicate with the smaller diameter portion 156 of the bore 154. Specifically, there is a pressure inlet port 32 (P), a pressure return port 34 (T), and a service port 38 (A) centrally disposed between the pressure inlet port 32 and pressure return port 34. As with the previous embodiments, the relative circumferential positions of the ports 32, 34 and 36 is without significance, the ports having been arranged in planar alignment in FIG. 9 primarily for purposes of illustration and clarity. The valve housing 152 also includes an inlet passageway 42 communicating between he pressure inlet port 32 and the end of the larger diameter portion 30 of the bore 154 adjacent the smaller diameter portion 156.

Axially slidably disposed within the bore 154 is a valve spool 160. At the end of the valve spool 160, more proximate the first end plate 16, is a first control land 162. The first land 162 defines an axially-extending channel or keyway 48 which slidably receives a complementarily sized and axial oriented key 50 formed in or secured to the wall of the bore 154 of the housing 152. Cooperation between the keyway 48 and key 50 permits axial translation of the valve spool 160, while restraining rotational motion about its axis.

Axially spaced from the first land 162 by a reduced diameter portion 168 is a second land 170. The second land 170 has a width measured along the axis of the valve spool 160 equal to the width of the service port 38 at its juncture with the bore 154. A second reduced diameter region 172 separates a second land 170 from a third land 174. The third land 174 extends from the second reduced diameter portion 72 to a piston 68. As in the other embodiments, the lands 162, 170 and 174 and the piston 68 are machined to provide approximately 1-1000th of an inch clearance between them and the surface of the bore 154. If desired, the piston 68 may be provided with an O-ring type seal. The lands may also be provided with circumferential centering grooves, if desired.

The piston 68 divides the second, larger diameter portion 30 of the bore 154, and defines a first chamber 72 and a second chamber 74. The exposed or effective area of the piston 68 in the first chamber 72 is preferably one-half of the effective area of the piston 68 in the second chamber 74. The inlet passageway 42 opens into the chamber 72 and thus provide communication between the pressure inlet port 32 and the first chamber 72. Connected to the piston 68 is a hollow, cylindrical sleeve 76 having male threads 78 of right hand sense. The male threads 78 are formed or cut such that significant lead, that is, axial translation, will occur with relatively small rotational motion. The pitch and lead of the male threads 78 affects the amplification of the second alternate embodiment rotary servo valve 150 are noted previously. The male threads 78 engage complementary right hand female threads 80 on the inner surface of a cylnder 82. The rotating cylinder 82 is supported within the chamber 74 of the housing 152 by a pair of spaced apart anti-friction bearings 84 in the manner described above for the preferred rotary servo valve 10.

The outer surface of the cylinder 82 defines a centrally disposed circumferential ridge 86 which the bearings 84 contact about their inner edges. Immediately adjacent the opposite, outer edges of the bearing assemblies 84 are a pair of circular retaining washers or rings 88 which are received within a respective pair of channels 90 formed on the wall of the second, larger diameter portion 30 of the bore 154. The bearing assemblies 84 thus support the cylinder 82 for free rotation about its axis but inhibit motion of the cylinder 82 in either direction along its axis. The male and female threads 78 and 80, respectively, provide a coupling which converts the axial motion of the valve spool 160 into rotating motion of the cylinder 82. The cylinder 82 defines a plurality of axial passageways 94 which provide communication between the interior and exterior of the cylinder 82.

Figure 8:
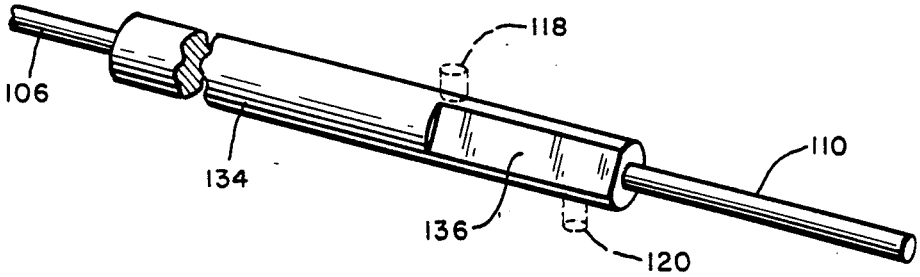
FIG. 8 is an enlarged, perspective view of the control rod of the first alternate embodiment of the present invention.

The valve spool 160 includes an axial control bore 100 which extends from one end of the valve spool 160 to the other. A first, single radial bore 176 extends from the first reduced diameter region 168 inwardly to the bore 100 and provides communication therebetween. A second, single radial bore 178 extends inwardly from the second reduced diameter region 172 to the bore 100 and provides communication therebetween. Slidably received within the bore 100 is a rotatable control rod 134 having an axially extending chordal portion removed thereby defining a chordal surface 136. (The control rod 134 is illustrated in FIG. 8). The chordal surface 136 and the axial bore 100 cooperatively define an axial passageway 138. The chordal surface 136 extends from the right end of the control rod 134 beyond the first radial bore 176. Extending from the end of the control rod opposite the chordal surface 136 is a first torsion rod 106, and extending from the end of the control rod 134 adjacent the chordal surface 136 is a second torsion rod 110. The end of the first torsion rod 106 is coupled to a torque motor 108, and the opposite end of the second torsion rod 110 is received within an opening in the rotating cylinder 82 and securely fastened thereto by a set screw 112 or other suitable fastening means.

In operation, the servo portion of the second alternate embodiment rotary servo valve 150 functions similarly to the preferred and first alternate embodiments of the rotary servo valve, but the valve provides a different result. That is, a rotational step input of, for example, 30°, is provided by the torque motor 108 in a clockwise direction as viewed in FIG. 10. The first torsion rod 106 transfers this motion, and the second torsion rod 110 provides a counter torque resisting it. Thus, the control rod 134 rotates one-half this input rotation, or 15° clockwise. Such rotation provides fluid communication from the pressure inlet port 32, through the second radial bore 178, along the axial passageway 138 formed by the chordal surface 136, to the chamber 74. Increased fluid pressure in the chamber 74 against the piston 68 translates the valve spool 160 axially to the left in FIG. 9, placing the pressure inlet port 32 in communication with the service port 38. This action provides a flow of fluid to the controlled device. When the axial motion of the valve spool 160 causes sufficient counter rotation of the control rod 134 (via the threaded sleeve 76, cylinder 82, and second torsion rod 110) the flow from the inlet port 32 to the chamber 74 will be terminated.

At this time, the pressure inlet port 32 will be in communication with the service port 38 through the second reduced diameter region 172 and the flow will be proportional to the magnitude of the rotational input provided by the torque motor 108. The second alternate embodiment rotary servo valve 150 thus functions as a proportional valve controlled by the low power input to the torque motor 108. Removal of the previously applied rotational input of the torque motor 108 will, through the reverse series of steps delineated above, return the valve spool 160 to the position illustrated in FIG. 9 and cause a cessation of fluid flow from the pressure inlet port 32 to the service port 38. Rotation of the torque motor 108 in the opposite direction will cause correspondingly opposite translation of the valve spool 160 to the right, thus permitting proportional fluid flow between the service point 38 and the pressure return port 34.

Figure 12:
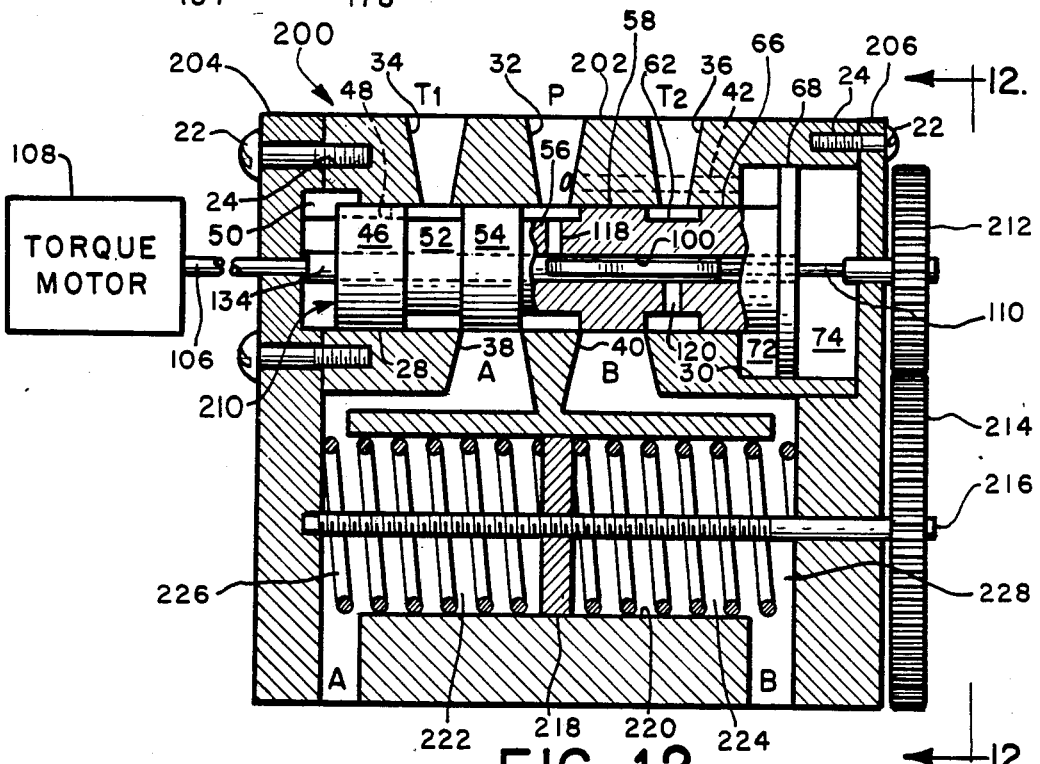
FIG. 12 is a longitudinal, full sectional view of a third alternate embodiment of the present invention.

Referring now to FIG. 12, a third alternate embodiment rotary servo valve 200 is illustrated. The alternate embodiment rotary servo valve 200 combines components and features of the other embodiments as will be readily appreciated from the illustration. The third alternate embodiment valve 200 provides a constant pressure output proportional to the input signal provided by the torque motor 108. The third alternate embodiment rotary servo valve 200 includes a housing 202. The housing 202 defines a bore 26 having a first, smaller diameter portion 28 and a second, larger diameter portion 30. The housing 202 also defines five ports which are radially disposed about and communicate with the smaller diameter region 28 of the bore 26. A centrally disposed pressure inlet port 32 (P) is disposed intermediate a first pressure return port 34 (T1) and a second pressure return port 36 (T2). Interleaved with the three just recited ports are a first service port 38 (A) and a second service port 40 (B). An inlet passageway 42 communicates between the pressure inlet port 42 and the larger diameter portion 30 of the bore 26 adjacent the smaller diameter portion 28.

The housing 202 includes a first end plate 204 and a second end plate 206 which are secured by machine screws 22, which are received within complementarily threaded blind openings 24 formed at appropriate locations in the housing 202.

The third alternate embodiment rotary servo valve 200 also includes a valve spool 210 having alternate lands and reduced diameter regions. The valve spool is substantially identical to the valve spool 116 of the first alternate embodiment. That is, it includes a first control land 46, a reduced diameter region 52, a second control land 54, a second reduced diameter region 56, a third control land 58, a third reduced diameter region 62, and a fourth control land 66. The first control land 46 defines a key way 48 which slidably receives a key 50 which inhibits rotation of the valve spool 210. A piston 68 disposed within the second, larger diameter portion 30 divides it into a first chamber 72 and second chamber 74.

The valve spool 210 also includes an axial control bore 100, a first radial bore 118 which extends between the axial bore 100 and the second reduced diameter region 56, and a second radial bore 120 which extends between the bore 100 and the third reduced diameter region 62. A control rod 134 is slidably and rotatably received within the axial bore 100. The control rod 134 is all respects identical to the control rod 134 utilized in the first alternate embodiment rotary servo valve 114, and includes a chordal surface 136 defining a passageway 138. A first torsion rod 106 is coupled to the control rod and torque motor 108, and a second torsion rod 110 is secured to the opposite end of the control rod and a first spur gear 212, preferably disposed externally of the housing 202. The first spur gear 212 is in constant mesh with a second spur gear 214, which is secured to a threaded shaft 216. The threaded shaft 216 is of right hand sense. The threaded shaft 216 is preferably disposed within the housing 202 on an axis parallel to that of the control rod 134 and valve spool 210, but may be otherwise oriented and coupled to the second torsion rod 110. A piston 218, having an opening with right-hand threads complementary to the threads on the threaded shaft 216, is disposed co-axially on the threaded shaft 216 and received within a cylinder 220. The left chamber 222 of the cylinder 220 and the left face of the piston 218 are in fluid communication with the first service port 38. The right chamber 224 of the cylinder 220 and right face of the piston 218 are in fluid communication with the second service port 40. A first compression spring 226 is positioned within the left chamber 222, and arranged concentrically about the threaded shaft 216. A second compression spring 228 is positioned within the right chamber 224, and arranged concentrically about the threaded shaft 216. The compression springs 226 and 228 preferably have identical spring rates and free lengths. The opposed compression springs 226, 228 bias the piston 218 in opposite directions.

The third alternate embodiment rotary servo valve 200 functions as a pressure control valve and its operation will now be described. The spool valve 210 and its associated control rod 134 operate in a manner similar to that of the first alternate embodiment rotary servo valve 114 and thus its operation will not be described in detail; reference to the foregoing section relating to the operation of the first alternate embodiment rotary servo valve 114 being suggested. It is important to note, however, that rotation of the control rod 134, and specifically the second torsion rod 110, results from axial translation of the piston 218, not from translation of the valve spool 210 as in the other embodiments.

It will be appreciated that actuation of the torque motor 108 and resultant rotation of the control rod 134 will cause lateral displacement of the valve spool 210 due to the fluid pressures applied to the control piston 68. Such rotation will also twist the torsion rods 106 and 110 creating a torque and counter torque therein. Displacement of the valve spool 210 resulting from the mechanical input provided by the torque motor 108 will place, for example, the pressure inlet port 32 in communication with the first service port 38. Such action will increase the fluid pressure within the left chamber 222 causing the piston 218 to move to the right until the centering force of the springs 226 and 228 counteracts this pressure imbalance. Lateral translation of the piston 218 is accompanied by rotation of the threaded shaft 216 and the second spur gear 214. In turn, the first spur gear 212 is rotated. Rotation of the first spur gear 212 rotates the control rod 134 through the second torsion bar 110 back to its original, neutral position. During the sequence of events, the torque motor 108 has maintained the end of the torsion rod 106 coupled to it in a fixed position.

Release of the step input and return of the torque motor 108 to its starting position will cause rotation of the control rod 134 in the opposite direction, such that the passageway 138 communicates with the second radial bore 120, reducing pressure in the second chamber 74 and causing translation of the valve spool 210 to the right as illustrated in FIG. 12. This activity reduces the pressure at those regions in fluid communication with the first service port 38, namely, the left chamber 222, thereby causing a pressure imbalance between it and the right chamber 224. The piston 218 thus translates to the left until the pressure imbalance is compensated for by the compression springs 226 and 228 and equilibrium is reached. Once again, as the piston 218 translates, the threaded shaft 216 rotates, causing rotation of the first and second spur gears 212 and 214 and return of the control rod 134 to its original null position.

Initial rotation of the control motor output 108 in the opposite direction and return to its initial position causes the opposite sequence of events as will be readily appreciated.

The primary advantage of the third alternate embodiment rotary servo valve 200 is that it maintains a constant output pressure at the service port, which is proportional to the input torque or degree of rotation of the torque motor 108, even if the pressure and, hence input flow, at the pressure inlet 32 fluctuates. For example, assume that the torque motor has been rotated so that the spool establishes communication between the inlet port 32 and first service port 38. If the input pressure at the inlet port 32 then decreases, there will be a reduction in pressure delivered to the first service port 38. The force imbalance across the piston 218 will move the piston 218 to the left. Such motion will be accompanied by rotation of the threaded shaft 216, the spur gears 212 and 214 and the control rod 134. This action will translate the valve spool 210 to the left to allow more fluid flow through the first service port 38. The lateral motion of the valve spool 210 will cease when the pressure imbalance across the piston 218 equals the spring centering force. The control rod 134 will then be in a null position. It will be appreciated that because of the compression springs 226 and 228, the piston 218 converts a pressure differential into rotational displacement of the threaded shaft 216. In turn, this displacement is fed to second torsion rod 110 and the control rod 143, which ultimately adjusts the lateral position of the valve spool 210. The third alternate embodiment rotary servo valve 200 therefore maintains a constant output pressure independent of input pressure and output flow. Thus, it can be used as a pressure control device in a closed loop servo system where a constant output pressure is desired. It can also be used as a pressure regulator.

It will be appreciated that a rotary servo valve according to the preferred embodiment and alternate embodiments provides a simple, yet sophisticated, servo device for use with various spool valve configurations and for various control applications. The present invention provides significant manufacturing and utilization benefits springing from its simple construction, ease of assembly, accurate control and low power consumption.

Figure 4:
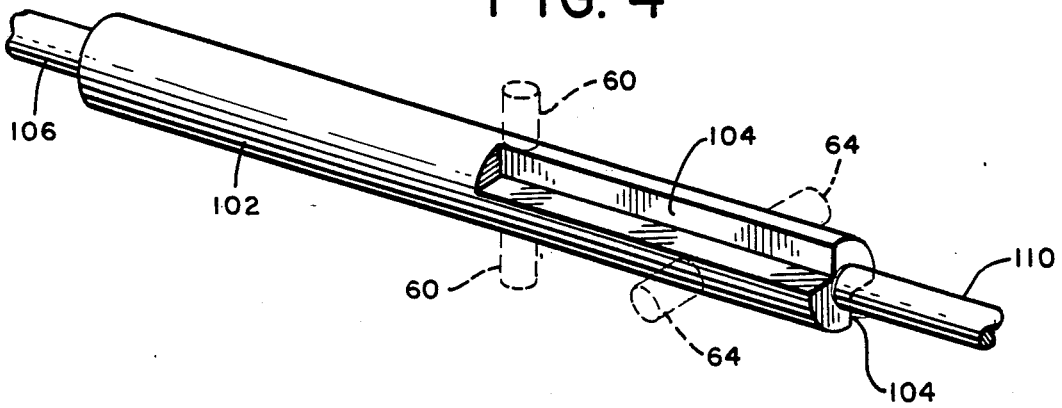
FIG. 4 is an enlarged, perspective view of the balanced control rod of the preferred embodiment of the present invention.

One feature significantly responsible for the low power consumption in high pressure applications is the balanced control rod 102 of the preferred embodiment in FIG. 4. Since it includes two opposed channels 104, fluid forces acting on it are likewise opposed and they cancel one another. This configuration of the control rod (with opposed rather than single radial bores) may be readily used with the alternate embodiments herein disclosed.

The foregoing disclosure is the best mode devised by the inventor for practicing this invention. It is apparent, however, that devices incorporating modifications and variations will be obvious to one skilled in the pertinent art. For example, the present invention can be implemented without a torsion rod connected between the input motor and control rod. Instead, the control rod can be directly coupled to the input motor, as shown in my co-pending application. Inasmuch as the foregoing disclosure is intended to enable one skilled in the pertinent art to practice the instant invention, it should not be construed to be limited thereby. It should be understood that it is the following claims, including all equivalants, that define the scope of this invention.

What is claimed is:

1. In a valve having a housing defining a plurality of ports communicating with a bore and a valve spool having alternate lands and reduced diameter regions slidably disposed within said bore, the improvement comprising:

said valve spool including an axial bore, and first and second radial bores axially spaced apart and communicating with said axial bore, a piston slidably disposed within an axial cylinder and defining a first chamber in fluid communication with one of said plurality of ports and a second chamber, a control rod rotatably disposed in said axial bore including a passageway extending axially at least from said radial bores to one end of said control rod, torsionally flexible means connected to said control rod for twisting in response to torques applied to its ends, and means connected to said piston and said torsionally flexible means for converting axial motion of said piston to rotational motion of said torsionally flexible means.

2. The improvement of claim 1 wherein said motion converting means includes a threaded member connected to said piston and a complementarily threaded rotatable member coupled to said torsionally flexible means.

3. The improvement of claim 1 wherein said valve spool further includes a third radial bore aligned with said first radial bore and communicating with said axial bore and a fourth radial bore aligned with said second radial bore and communicating with said axial bore, and said control rod further includes a second passageway extending axially from at least between said radial bores and one end of said control rod.

4. The improvement of claim 1 wherein said motion converting means includes a pair of threaded shafts extending from said piston, a pair of rotatable pinion gears having complementarily threaded openings disposed on said threaded shafts, said pinion gears meshing with a spur gear coupled to said torsionally flexible means.

5. The improvement of claim 1 wherein said ports include a fluid inlet port, a fluid return port and first and second service ports, said first chamber in fluid communication with said first service port, said second chamber in fluid communication with said second service port, and said motion converting means includes a rotatable threaded member extending through a threaded aperture in said piston, means for coupling said threaded member to said torsionally flexible member, and means for biasing said piston in opposed directions.

6. The improvement of claim 5 further including a second piston coupled to said valve spool, said second piston defining a first region in fluid communication with said inlet port and a second region in fluid communication with said axial passageway.

7. A rotary servo valve comprising:

a housing defining a bore and a plurality of ports axially spaced along and communicating with said bore, a valve spool slidably disposed within said housing bore, said valve spool having a plurality of alternating lands and reduced diameter regions, an axial control bore, and first and second radial passageways axially spaced apart and communicating with said axial bore, a control rod rotatably disposed within said axial control bore, said control rod including an axial passageway extending from said radial passageways to a first end of the control rod, whereby rotation of said control rod in one direction places said first radial passageway in communication with said axial passageway and rotation of said control rod in the opposite direction places said second radial passageway in communication with said axial passageway, a torsionally flexible means connected to said control rod for twisting in response to applied torque, and conversion means coupled to said torsionally flexible means and said valve spool for rotating said control rod in response to axial translation of said valve spool.

8. A rotary servo valve comprising:

a housing defining a bore and an inlet port, at least one return port, and first and second service ports axially spaced along and communicating with said housing bore, a valve spool slidably disposed within said housing bore, said valve spool having a plurality of alternating lands and reduced diameter regions, an axial bore, and first and second radial passageways axially spaced apart and communicating with said axial bore, a control rod rotatably disposed within said axial bore, said control rod including an axial passageway extending from said radial passageways to an end of said control rod, a torsionally flexible means connected to said control rod for twisting in response to applied torque, a piston slidably received within a cylinder and defining first and second chambers, said first chamber in fluid communication with said first service port, and said second chamber in fluid communication with said second service port, a means in each of said first and second chambers for biasing said piston in opposed direction, and means for converting axial motion of said piston into rotational motion of said torsionally flexible means.

9. The rotary servo valve of claim 8 further including means for restraining rotation of said valve spool.

10. The rotary servo valve of claim 8 wherein the converting means includes a threaded opening extending axially through said piston, a complementarily threaded, rotatable shaft received within said piston opening, and means for coupling said threaded shaft to said torsionally flexible means, whereby axial motion of said piston along said threaded shaft is converted to rotational motion of said torsionally flexible means.

11. The rotary servo valve of claim 10 wherein the coupling means includes a first gear connected to said threaded shaft, and a second gear connected to said torsionally flexible means and said first gear.

12. The rotary servo valve of claim 11 wherein said biasing means includes a pair of opposed compression springs, one of said compression springs being disposed in each of said first and second chambers.

13. The rotary servo valve of claim 8 further including a second piston connected to the valve spool and defining third and fourth chambers, said housing including an inlet passageway communicating between said pressure inlet port and said third chamber, and said fourth chamber communicating with said axial passageway.

14. The rotary servo valve of claim 8 further including a second torsionally flexible means coupled to the control rod, opposite said first torsionally flexible means, and input means for rotating said second torsionally flexible means.

15. A rotary servo valve comprising:

a housing defining a bore, an inlet port, at least one return port and at least one service port, said ports axially spaced along and communicating with said housing bore, a valve spool slidably disposed within said housing bore, said valve spool having a plurality of alternating lands and reduced diameter regions, a piston defining a first chamber and a second chamber, an axial bore extending through said valve spool, and first and second radial passageways axially spaced apart and communicating with said axial bore an inlet passageway communicating between said inlet port and said first chamber, means for inhibiting rotation of said valve spool, a control rod rotatably disposed within said axial bore, and including an axial passageway extending from the radial passageways to one end of the control rod, whereby rotation of said control rod in one direction places said first radial passageway in communication with said second chamber and rotation of said control rod in the opposite direction places said second radial passageway in communication with said second chamber, a torsion rod connected to an end of said control rod, input means for rotating said control rod, and conversion means coupled to said piston and said torsion rod for rotating said torsion rod in response to axial translation of said piston.

16. A rotary servo valve comprising:

a housing defining a bore and a plurality of ports axially spaced along and communicating with said bore, a valve spool slidably disposed within said housing bore, said valve spool having a plurality of alternating lands and reduced diameter regions, an axial control bore, and first and second radial passageways axially spaced apart and communicating with said axial bore, a control rod rotatably disposed within said axial control bore, said control rod including an axial passageway extending from said radial passageways to a first end of the control rod, whereby rotation of said control rod in one direction places said first radial passageway in communication with said axial passageway and rotation of said control rod in the opposite direction places said second radial passageway in communication with said axial passageway, a torsionally flexible means connected to said control rod for twisting in response to applied torque, and conversion means coupled to said torsionally flexible means and said valve spool for rotating said control rod in response to axial translation of said valve spool, said conversion means including a threaded member connected to said valve spool and a complementarily threaded member coupled to said torsionally flexible means and disposed for rotation by axial motion of said threaded member.

17. A rotary servo valve comprising:

a housing defining a bore and a plurality of ports axially spaced along and communicating with said bore, a valve spool slidably disposed within said housing bore, said valve spool having a plurality of alternating lands and reduced diameter regions, an axial control bore, and first and second radial passageways axially spaced apart and communicating with said axial bore, a control rod rotatably disposed within said axial control bore, said control rod including an axial passageway extending from said radial passageways to a first end of the control rod, whereby rotation of said control rod in one direction places said first radial passageway in communication with said axial passageway and rotation of said control rod in the opposite direction places said second radial passageway in communication with said axial passageway, a torsionally flexible means connected to said control rod for twisting in response to applied torque, and conversion means coupled to said torsionally flexible means and said valve spool for rotating said control rod in response to axial translation of said valve spool, said conversion means including a pair of threaded shafts extending from said valve spool, a pair of pinion gears having complementarily threaded openings disposed for rotation by axial motion of said threaded shafts, said pinion gears meshing with a centrally disposed spur gear connected to said torsionally flexible means.

18. A rotary servo valve comprising:

a housing defining a bore, an inlet port, at least one return port and at least one service port, said ports axially spaced along and communicating with said housing bore, a valve spool slidably disposed within said housing bore, said valve spool having a plurality of alternating lands and reduced diameter regions, a piston defining a first chamber and a second chamber, an axial bore extending through said valve spool, and first and second radial passageways axially spaced apart and communicating with said axial bore, an inlet passageway communicating between said inlet port and said first chamber, a control rod rotatably disposed within said axial bore, and including an axial passageway extending from the radial passageways to one end of the control rod, whereby rotation of said control rod in one direction places said first radial passageway in communication with said second chamber and rotation of said control rod in the opposite direction places said second radial passageway in communication with said second chamber, first and second torsion rods connected to opposite ends of said control rod, input means connected to said first torsion rod for rotating said first torsion rod and said control rod, and conversion means coupled to said piston and said second torsion rod for rotating said second torsion rod and said control rod in response to axial translation of said piston, said conversion means including a threaded member connected to said piston and a complementarily threaded member coupled to said second torsion rod and disposed for rotation by axial motion of said threaded member.

19. The rotary servo valve of claim 18 further including means for axially restraining said complementarily threaded member.

20. A rotary servo valve comprising:

a housing defining a bore, an inlet port, at least one return port and at least one service port, said ports axially spaced along and communicating with said housing bore, a valve spool slidably disposed within said housing bore, said valve spool having a plurality of alternating lands and reduced diameter regions, a piston defining a first chamber and a second chamber, an axial bore extending through said valve spool, and first and second radial passageways axially spaced apart and communicating with said axial bore, an inlet passageway communicating between said inlet port and said first chamber, a control rod rotatably disposed within said axial bore, and including an axial passageway extending from the radial passageways to one end of the control rod, whereby rotation of said control rod in one direction places said first radial passageway in communication with said second chamber and rotation of said control rod in the opposite direction places said second radial passageway in communication with said second chamber, first and second torsion rods connected to opposite ends of said control rod, input means connected to said first torsion rod for rotating said first torsion rod and said control rod, and conversion means coupled to said piston and said second torsion rod for rotating said second torsion rod and said control rod in response to axial translation of said piston, said conversion means including a pair of threaded shafts extending from said piston, a pair of pinion gears having complementarily threaded openings disposed for rotation by axial motion of said threaded shafts, said pinion gears in mesh with a rotatable spur gear secured to said second torsion rod.

21. The rotary servo valve of claim 20 further including means for restraining rotation of said valve spool.

22. A rotary servo valve comprising:

a housing defining a bore and an inlet port, at least one return port, and first and second service ports axially spaced along and communicating with said housing bore, a valve spool slidably disposed within said housing bore, said valve spool having a plurality of alternating lands and reduced diameter regions, an axial bore, and first and second radial passageways axially spaced apart and communicating with said axial bore, a control rod rotatably disposed within said axial bore, said control rod including an axial passageway extending from said radial passageways to an end of said control rod, first and second torsionally flexible means connected to opposite ends of said control rod for twisting in response to applied torque, input means connected to said first torsionally flexible means for rotating said first torsionally flexible means and said control rod, a piston slidably received within a cylinder and defining first and second chambers, said first chamber in fluid communication with said first service port, and said second chamber in fluid communication with said second service port, a means in each of said first and second chambers for biasing said piston in opposed directions, and means for converting axial motion of said piston into rotational motion of said second torsionally flexible means, the converting means including a threaded opening extending axially through said piston, a complementarily threaded, rotatable shaft received within said piston opening, and means for coupling said threaded shaft to said second torsionally flexible means, whereby axial motion of said piston along said threaded shaft is converted to rotational motion of said second torsionally flexible means and said control rod.

23. The rotary valve of claim 22 wherein the coupling means includes a first gear connected to said threaded shaft, and a second gear connected to said second torsionally flexible means and said first gear.

* * * * *